US006894000B2

(12) United States Patent
Bhambra

(10) Patent No.: US 6,894,000 B2
(45) Date of Patent: May 17, 2005

(54) METHOD FOR PREPARING IMAGED MEMBERS AND IMAGED MEMBERS PREPARED THEREBY

(75) Inventor: Harjit Singh Bhambra, Delta (CA)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 10/134,168

(22) Filed: Apr. 26, 2002

(65) Prior Publication Data

US 2003/0203299 A1 Oct. 30, 2003

(51) Int. Cl.[7] ..... B41M 5/30

(52) U.S. Cl. ..... 503/201; 427/264; 430/302; 430/309; 430/311

(58) Field of Search ..... 427/150, 152, 427/264; 430/302, 309, 311; 503/200, 201, 226

(56) References Cited

U.S. PATENT DOCUMENTS

| | | | | |
|---|---|---|---|---|
| 2,048,964 A | | 7/1936 | Osborn | 101/401.1 |
| 3,319,564 A | | 5/1967 | Goffredo | 101/401.1 |
| 3,424,635 A | | 1/1969 | Grandinetti et al. | 156/150 |
| 3,907,564 A | * | 9/1975 | Boardman et al. | 430/302 |
| 3,979,212 A | | 9/1976 | Peters et al. | 96/86 |
| 4,032,684 A | | 6/1977 | Dunnington et al. | 428/332 |
| 4,092,925 A | | 6/1978 | Fromson | 101/467 |
| 5,127,327 A | | 7/1992 | Philpot | 101/415.1 |
| 6,124,236 A | * | 9/2000 | Mitchell, Jr. | 503/201 |

FOREIGN PATENT DOCUMENTS

| | | |
|---|---|---|
| CH | 599576 | 5/1978 |
| DE | 3007703 | 10/1980 |
| DE | 4010731 | 10/1990 |
| EP | 0220943 | 5/1987 |
| EP | 0449131 | 10/1991 |
| EP | 0644064 | 3/1995 |
| EP | 0690349 | 1/1996 |
| EP | 0807534 | 11/1997 |
| JP | 03073392 | 3/1991 |
| JP | 0761746 | 3/1995 |
| JP | 09304928 | 11/1997 |
| JP | 09311446 | 12/1997 |
| JP | 09325491 | 12/1997 |
| WO | 9310979 | 6/1993 |
| WO | 9853371 | 11/1998 |

OTHER PUBLICATIONS

U.S. Appl. No. 10/134,204, filed Apr. 26, 2002, inventor—Harjit Bhambra.

* cited by examiner

*Primary Examiner*—Bruce Hess
(74) *Attorney, Agent, or Firm*—Faegre & Benson, LLP

(57) ABSTRACT

The invention comprises a method of preparing an imaged member comprising a substrate having an imagable coating on a face thereof, the method comprising the steps of:

(a) imaging a precursor of the member to produce an imaged member which includes image and non-image areas on the coated face; and (b) treating the substrate to increase its dimensional stability, the treatment comprising at least one of:

(i) effecting a change in the chemical structure of the substrate, or (ii) coating a non-coated face of the substrate with a fluid, gel, or particulate solid.

41 Claims, No Drawings

METHOD FOR PREPARING IMAGED MEMBERS AND IMAGED MEMBERS PREPARED THEREBY

BACKGROUND OF THE INVENTION

1. Field of the Invention

This invention relates to methods of preparing imaged members and imaged members prepared thereby. In particular, but not exclusively, this invention relates to methods of preparing imaged printing forms, electronic parts and masks.

2. Background Information

Imaged articles, such as printing forms, electronic parts and masks, conventionally comprise a substrate onto which has been coated a film forming radiation-sensitive composition, the composition having been image-wise exposed to radiation of suitable wavelength, and developed to produce the imaged member.

A common form of printing plate used in the printing industry is the lithographic printing plate. Many lithographic printing plates are imaged within imagesetters. In the manufacture of such lithographic plates, plate precursors in the form of rolls or sheets of flexible material are generally fed into the image setting apparatus and digitally imaged within the imagesetter before being forwarded to prepress processing and then on to a printing press. Imagesetters generally include one or more rollers or angular components around which the flexible precursor must bend during imaging. Thus, the substrate of the precursor must be flexible enough to allow passage over rollers and angular components. As such, typical substrates used for lithographic printing forms include flexible polyester sheets and paper sheets. The inherent flexibility of these materials allows the precursor to travel round rollers and angular components with relatively little damage to the structure of the substrate and imaged precursor.

However, problems arise once the imaged precursor has travelled through the imagesetter and undergoes prepress processing and clamping to the press cylinder of the printing press. In order for efficient printing to be effected, the imaged member must be securely clamped to the printing press, and pulled taught such that there are no inconsistencies in the relief of the plate on the press. Generally, such plates are pulled taught by the practice of clamping both the leading and trailing edge of the plate to the print cylinder. The practice of clamping and tightening of the imaged member can easily stretch flexible substrates such as polyester and paper when mechanically stressed. Stretching of the substrate induces stretching of the imaged coating on the substrate, which may distort any image printed from that particular plate. Furthermore, there is a danger that, with particularly flexible substrates such as paper, tightening of the imaged member on the printing press will lead to tearing of the substrate with a subsequent loss of image.

Thus, the inherent flexibility of such plates while advantageous for the process of imaging in an imagesetter, also confers inherent dimensional instability on those substrates, which can be disadvantageous when mounting the substrate on a printing cylinder.

Other more dimensionally stable forms of substrate can be used, such as aluminum plates, but their inherent inflexibility precludes them from being passed through imagesetters. As imagesetters are used by many printing operatives around the globe, the cost of converting from using image setting equipment to equipment which can utilize inflexible aluminum plates can be financially prohibitive.

Other imaged members such as flexographic printing plates and printed circuit boards are commonly made from thick sheets of semi-flexible plastic substrate. The thickness of the sheet is used to effect sufficient dimensional stability to the substrate against stresses encountered during use. The use of thick substrates is relatively expensive and there is a desire in the industry to reduce substrate thickness whilst maintaining dimensional stability.

For flexographic plates in particular, historically these imaged members have been imaged by using film as a masking medium. The need for separate masking medium is relatively labor intensive and enhances the cost of producing such flexograhpic plates. The flexographic printing plate industry has consequently been looking for ways to reduce costs and labor intensity of producing such plates. One method of reducing costs and labor intensity, would be to adopt the digital imaging readily available in image setting equipment, which eliminates the need for masking medium and its associated costs. However, the thickness and relative inflexibility of the substrates used in flexographic printing, compared to the flexible substrates used in lithographic printing, prevents their use in conventional filmsetting equipment.

EP 644064 (Agfa) discloses a lithographic printing plate comprising on a first side of a flexible support a surface differentiated in oleophilic and oleophobic areas and on the second side a layer of micro particles of pressure sensitive adhesive. The layer of pressure sensitive adhesive is covered by a covering layer, which layer is peeled off before the flexible support is adhered to a printing press surface under tension. The micro particles do not increase the dimensional stability of the flexible support and merely serve to allow adhesion of the printing form precursor on the printing press.

U.S. Pat. No. 4,092,925 (Fromson) discloses a lithographic printing plate system comprising an aluminum printing member having a light sensitive coating thereon applied by a carrier plate releasably adhered to the aluminum printing member. The carrier plate increases the dimensionally stability of the aluminum printing member, but the inflexibility of the aluminum printing member prevents the aluminum printing member being passed through an image setter prior to adhesion of carrier plate.

U.S. Pat. No. 2,048,964 (Osborn) discloses a planar graphic printing plate comprising a non-metallic core surface encased on both sides by metallic facings, the metallic facings being coextensive with the core and secured thereto to waterproof the site thereof. The planar graphic printing plate is non-flexible, and cannot be passed through an imagesetter containing multiple roller and sharp angles. Furthermore, the lamination of two sides of metallic facings is relatively expensive.

EP 690349 (Dupont) discloses a flexible lithographic printing form comprising a laminate of flexible substrate and aluminum sheeting. The resultant laminate is flexible enough to be passed through an imagesetter, but the use of an aluminum sheeting is relatively expensive, and special laminating equipment and procedures must be employed in order to create the laminated plates.

U.S. Pat. No. 4,032,684 (Dunnington et al) discloses a method of manufacturing a composite lithographic printing form, the printing form comprising a metal surface having a lithographic quality composition coated thereon, and a backing sheet laminated to the uncoated surface of the metal sheet. As described for EP 690349 A, the printing forms disclosed in U.S. Pat. No. 4,032,684, being laminated, are relatively expensive to manufacture and involve the use of complicated laminating machinery and laminating procedures.

WO 93/10979 (Aloisi) discloses a pre-sensitized lithographic printing plate comprising a backing film of plastic material laminated to a sheet of aluminum foil, which is coated with a photosensitive composition, The thickness of the backing material is 1 to 4 times greater than the thickness of aluminum foil. As with EP 690349 A, the printing forms disclosed in WO 93/10979 are laminates, requiring specialised laminating machinery and laminating procedures, including the use of adhesives. The need for multiple layers of metal and backing increases production costs considerably as compared to a single layers of lithographic printing form.

U.S. Pat. No. 3,979,212 (Peters et al. ) discloses a lithographic printing form comprising an aluminum sheet laminated to a non-stainless steel sheet with an adhesive. The laminate disclosed in U.S. Pat. No. 3,979,212 is inflexible and cannot be used through an imagesetter which comprises rollers and sharp angles. Furthermore, the use of multiple metallic laminated sheets is relatively expensive and requires specialized machinery for manufacture.

EP 807534 A (Agfa) discloses a flexible supported lithographic printing plate having improved dimensional stability. The printing plate of EP 807534A comprises a flexible support to which is laminated a dimensionally stable base suitably adapted for mounting on a printing press. The dimensionally stable bases are disclosed to be aluminum plates. As described for the previously disclosed prior art, the laminated plates of EP 807534 A are relatively expensive to manufacture due to the need for multiple layers and laminating equipment and procedure.

WO 98/53371 discloses an image plate comprised of a at least one stiffening layer formed from a first polymer material and a print contact layer formed from a second polymer material laminated together. The print contact layer is a relief contact layer having raised protrusions which form the print image of the printing plate. The print contact layer is covered by a releasable layer until an image is desired to be printed. The printing form of WO 98/53371 is a letterpress printing form, which cannot be passed through lithographic imagesetters. imagesetters. Furthermore, the laminated structure of the letterpress printing forms of WO 98/53371 are relatively expensive produced due to the need for multiple layers, laminating equipment and procedures.

JP 3073392 A (Mitsubishi Papermills Limited) discloses a base material for a lithographic printing plate, the base material comprising a resin coated paper base material, the base material being impregnated with a composition hardenable by electron beam radiation. The resin coating is disclosed as being a fused polyolefin resin layer which is also electron beam hardenable. The printing plate is formed by irradiating the coated paper such that the impregnated paper and resin coating are both hardened by electron beam radiation. The resultant printing plate can then be coated with a lithographic imaging composition and imagewise exposed and developed. In this printing plate, the printing plate is first dimensional stabilized and then passed through an imagesetter for imagewise exposure. The use of a double layer of hardenable material in which both layers are electron beam irradiated is relatively expensive and the addition of an imageable coating increases the thickness of the dimensionally stabilized imagesetter handling capabilities of the substrate.

There is therefore a need in the lithographic printing, flexographic printing and printed circuit board industries for a substrate which is both imagesetter compatible in its flexibility, but which after imaging is dimensionally stable enough to endure the mechanical stress of being tightened over a printing cylinder, or on printing surface in the case of circuit boards, and which is relatively cheap and quick to manufacture.

Traditionally four printing units are employed in succession for four-color printing; yellow, cyan, magenta and black units in series. Each unit carries a printing plate. If flexible plates are used, a further problem can arise due to distortion of one or more flexible plate of the four units, resulting in color overlap between two or more colors, leading to image distortion and unacceptable print images. For this reason plastics and paper substrates have generally been restricted to black and white, and spot color (black and white with one color) printing.

It is therefore an aim of preferred embodiments of the present invention to overcome or mitigate at least one of the above problems of the prior art, or other problems, whether expressly described hereinabove or not.

SUMMARY OF THE INVENTION

According to a first aspect of the present invention there is provided a method of preparing an imaged member comprising a substrate having an imageable coating on a face thereof, the method comprising the steps of:

(a) imaging a precursor of the member to produce an imaged member which includes image and non-image areas on the coated face; and (b) treating the substrate to increase its dimensional stability, the treatment comprising at least one of the following:

(i) effecting a change in the chemical structure of the substrate, or (ii) coating a non-coated face of the substrate with a fluid, gel, or particulate solid.

By dimensional stability we mean the structural capability of the substrate to resist damage from mechanical stress. Resistance may be against stretching, breaking, tearing, distortion, indentation, warping, buckling or contraction caused by mechanical stress, for example.

DETAILED DESCRIPTION OF THE INVENTION

Preferably the change in the chemical structure of the substrate is effected by the application of at least one of heat, pressure and radiation.

When the change in the chemical structure is effected by the application of heat, suitably the substrate is heated to at least 200° C., preferably at least 230° C. and more preferably at least 250° C. Suitably the substrate is heated for at least 60 seconds and more preferably at least 120 seconds.

When the change in the chemical structure is effected by the application of pressure, suitably the substrate is subjected to at least 10 pounds per square inch ($68.95\times10^3$ Pa) of pressure, preferably at least 50 pounds per square inch ($344.75\times10^3$ Pa), more preferably at least 200 pounds per square inch (1379×103 Pa), still more preferably at least 500 pounds per square inch ($344.75\times10^3$ Pa) and most preferably at least 1 ton per square inch ($6895\times10^3$ Pa).

In a preferred embodiment, the change in the chemical structure of the substrate is effected by the application of heat and the application of pressure. Suitably the application of heat and pressure are effected simultaneously.

The change in the chemical structure of the substrate may be effected by exposing the substrate to a temperature sufficient to initiate thermal cross-linking of free functional groups of the substrate. After exposing the substrate to a temperature sufficient to initiate thermal cross-linking of free functional groups of the substrate, the substrate may then be exposed to pressure of at least 10 pounds per square inch ($68.95\times10^3$ Pa) to effect a further increase in dimensional stability of the substrate.

When the change in the chemical structure of the substrate is effected by exposing the imaged member to radiation, suitably the radiation is electromagnetic radiation, which may be ultraviolet, visible or infrared radiation. Preferably the radiation is ultraviolet radiation, having a wavelength of between about 254 nm and about 400 nm. The substrate may be contacted with a photoinitiator before or during exposure of the substrate to the electromagnetic radiation.

Suitable photoinitiators for use on plastics or paper substrates include benzophenone, xanthone, thioxanthone, Micheler's ketone, benzil, 9,10-phenanthoquinone, 1-phenyl-1,2-propanedione, diethylhydroxyactophenone and 2-(O-benzoyl)oxime.

In another embodiment of the invention, the change in the chemical structure of the substrate may be effected by contacting the substrate with a chemical agent.

The chemical agent may be a cross-linking or curing agent. The type of curing agent used will vary depending on the substrate. Examples of suitable curing agents for plastics substrates include orthochloroaniline-formaldehyde, propylene glycol (50:50), 4-4'-diaminodiphenyl methane, and a mixture of 20% thiophosphorin-tris-(isocyanato-phenyl ester) and 80% methylene chloride or polyisocyanate in ethylene.

Suitable curing agents for rubber substrates include bis [3-(triethyloxysilyl)propyl tetrasulphide] and a mixture of 20% thiophosphorin-tris-(isocyanato-phenyl ester) and 80% methylene chloride or polyisocyanate in ethylene.

When the change in the chemical structure of the substrate is effected by the application of at least one of heat, pressure and radiation, the substrate may be contacted with a chemical cross-linking agent before or during application of the at least one of heat, pressure and radiation.

When the treatment to increase the dimensional stability of the substrate comprises coating a non-coated surface of the substrate with a fluid, gel or particulate solid, preferably the substrate is coated with a fluid comprising a suspension, dispersion, or solution of a solid in a suitable liquid; an emulsion or a molten solid.

Suitably the suspension, dispersion, or solution is allowed to dry (so as to substantially evaporate the solvent) to provide a solid coating on the substrate. In the case of a molten solid, preferably the molten solid is allowed to solidify to provide the solid coating. The molten solid may be an air-cured epoxy resin.

Preferably the substrate of the imaged member comprises a flexible plastics substrate, elastomeric substrate or a paper substrate.

Suitable plastics substrates include epoxy, polyester, polyethylene terephthalate and polyethylene substrates. Suitable paper substrates include phenolic paper substrates and cotton rag paper substrates.

The terms "elastic yield", "force needed to exceed elastic yield", "percentage elongation at elastic yield", "break point", "force needed to exceed break point" and "percentage elongation at break point" are used hereinafter and have the following meanings in relation to substrates:

By "elastic yield" we mean the limit to which the substrate can be strained with a load and still return to its original length on unloading.

By "force needed to exceed elastic yield" we mean the load required to exceed the elastic yield point and enter inelastic extension.

By "percentage elongation at elastic yield" we mean the percentage elongation of the substrate at the elastic yield compared to the length of the original unstressed substrate.

By "break point" we mean the limit to which the substrate may be strained with a load until fracture of the substrate.

By "force needed to exceed break point" we mean the load required to exceed the break point of the substrate and fracture the substrate.

By "percentage elongation at break point" we mean the percentage elongation of the substrate at the break point compared to the length of the original unstressed substrate.

When the imaged member comprises a plastics substrate, suitably the dimensional stability of the plastics substrate is increased such that the force needed to exceed the elastic yield of the substrate is increased by at least 30%, more preferably at least 40%, and most preferably at least 50%, compared to the untreated substrate.

When the imaged member comprises a plastics substrate, suitably the dimensional stability of the plastics substrate is increased such that the elastic yield (in MPa) of the substrate is increased by at least 3%, preferably at least 5%, and more preferably at least 10% as compared to the untreated substrate.

When the imaged member comprises a plastics substrate, suitably the dimensional stability of the plastics substrate is increased such that the percentage elongation at the elastic yield point of the substrate is decreased by at least 3%, more preferably at least 5%, and most preferably at least 10%, compared to the untreated substrate.

When the imaged member comprises a plastics substrate, suitably the dimensional stability of the plastics substrate is increased such that the Young's Modulus of the substrate is increased by at least 20%, more preferably at least 30%, and most preferably at least 40%, compared to the untreated substrate.

When the imaged member comprises a plastics substrate, suitably the dimensional stability of the plastics substrate is increased such that the force needed to exceed the break point of the substrate is increased by at least 5%, more preferably at least 15%, and most preferably at least 25%, compared to the untreated substrate.

When the imaged member comprises a plastics substrate, suitably the dimensional stability of the plastics substrate is increased such that the break point of the substrate is increased by at least 3%, more preferably at least 5%, and most preferably at least 10%, compared to the untreated substrate.

When the imaged member comprises a plastics substrate, suitably the dimensional stability of the plastics substrate is increased such that the percentage elongation at the break point of the substrate is decreased by at least 5%, more preferably at least 10%, and most preferably at least 15%, compared to the untreated substrate.

When the imaged member comprises a paper substrate, suitably the dimensional stability of the paper substrate is increased such that the elastic yield force needed to exceed the elastic yield of the substrate is increased by at least 20%, preferably at least 30%, and more preferably at least 40%, compared to the untreated substrate.

When the imaged member comprises a paper substrate, suitably the dimensional stability of the paper substrate is increased such that its elastic yield (in MPa) is increased by at least 20%, preferably at least 30%, and more preferably at least 40%, compared to the untreated substrate.

When the imaged member comprises a paper substrate, suitably the dimensional stability of the paper substrate is increased such that the percentage elongation at the elastic yield is decreased by at least 25%, preferably at least 30%, and more preferably at least 35%, compared to the untreated substrate.

When the imaged member comprises a paper substrate, suitably the dimensional stability of the paper substrate is increased such that the Young's Modulus is increased by at least 25%, preferably at least 35%, and more preferably at least 45%, compared to the untreated substrate.

When the imaged member comprises a paper substrate, suitably the dimensional stability of the paper substrate is increased such that the break force needed to exceed the break point of the substrate is increased by at least 25%, preferably at least 35%, and more preferably at least 45%, compared to the untreated substrate.

When the imaged member comprises a paper substrate, suitably the dimensional stability of the paper substrate is increased such that the break point is increased by at least 10%, preferably at least 20%, and more preferably at least 30%, compared to the untreated substrate.

When the imaged member comprises a paper substrate, suitably the dimensional stability of the paper substrate is increased such that the percentage elongation at the break point is decreased by at least 5%, preferably at least 10%, and more preferably at least 15%, compared to the untreated substrate.

The imaged member may, after treatment to increase its dimensional stability, be laminated on the non-coated side of the imaged member to a dimensionally stable base.

The dimensionally stable base may be a plastic base, an aluminum base or the like, for example. The dimensionally stable base may be laminated to the imaged member by coating the imaged member and/or dimensionally stable base with an adhesive and adhering the dimensionally stable base to the imaged member.

The coating may comprise a positive working composition or a negative working composition.

The imageable coating may be a diazo coating, photopolymer coating, silver halide coating, electrophotographic coating, thermally sensitive coating, ablatable coating or a coating suitable for waterless printing. Each of these coatings is well known to those skilled in the art.

The coating is preferably such that it is image-wise exposable by radiation. Preferred coatings are such that they may be image-wise insolubilized or image-wise solubilized by radiation.

The radiation itself may be emitted image-wise in order to effect image-wise exposure of the precursor.

For example the radiation may be emitted image-wise by a laser.

The radiation may alternatively be flood emitted through a screen, the screen comprising image and non-image areas, wherein either the image or non-image areas are transparent to the radiation emitted.

Alternatively the image-wise exposure of the precursor may be effected indirectly by exposure to radiation transmitted or reflected from the background areas of a graphic original located in contact with the precursor.

In preferred methods of the invention the radiation used to expose the precursor is visible and/or UV radiation. Preferably, it is of wavelength entirely or predominantly exceeding 200 nm, more preferably entirely or predominantly exceeding 300 nm. Preferably it is of wavelength entirely or predominantly below 800 nm, more preferably entirely or predominantly below 450 nm.

Thus a preferred wavelength of the radiation used to expose the precursor is 300 nm to 450 nm.

Preferably the sensitivity of the photosensitive composition coated on the precursor is at a practicable level, but is suitably no more that 400 mJcm−1, preferably no more than about 300 $mJcm^{-1}$.

The radiation may be delivered by any suitable light source such as a xenon lamp, a metallohalogen lamp, a tungsten bulb or a laser, for example an excimer laser.

Preferably the visible and/or UV sensitive coating comprises a diazide moiety.

The diazide moieties preferably comprise diazo groups, =N2, conjugated to carbonyl groups, preferably via an aromatic or heteroaromatic ring. In such moieties a carbonyl group is preferably bonded to the aromatic or heteroaromatic ring at an adjacent ring position to the diazo group. Preferred moieties are o-benzoquinonediazide (BQD) moieties (often referred to as o-quinonediazides) and o-naphthoquinonediazide (NQD) moieties.

A BQD moiety may, for example, comprise a 1,4- or, preferably 1,2-benzoquinonediazide moiety.

An NQD moiety may, for example, comprise a 1,4-, 2,1- or, most preferably, a 1,2-naphthoquinone diazide moiety.

Generally, NQD moieties are preferred to BQD moieties in the practice of the invention.

Most preferred in the practice of the present invention is a 1,2-naphthoquinonediazide moiety.

The diazide may be present as a simple compound admixed into the composition or, as is preferred, as a moiety which is covalently bonded as a functional group to a polymer of the composition.

Preferred diazide compounds are sulfonyl compounds in which the group —$SO_2$— is bonded to an aromatic ring, suitably to the 5- or, especially, to the 4-position of a naphthyl ring. Its other chemical bond may be to a polymer chain or may be to a ballast moiety such as a hydroxylbenzophenone group, especially 2,4-dihydroxyphenone.

Examples of preferred naphthoquinone diazide moieties which may be used in the photosensitive composition are disclosed in a variety of publications such as U.S. Pat. Nos. 2,766,118; 2,767,092; 2,772,972; 2,859,112; 2,907,665; 3,046,110; 3,046,111; 3,046,115; 3,046,118; 3,046,119; 3,046,120; 3,046,121; 3,046,122; 3,036,123; 3,061,430; 3,102,809; 3,105,465; 3,635,709; and 3,647,443. Among these, preferred are o-naphthoquinonediazido sulfonates or o-naphthoquinonediazido carboxylates of aromatic hydroxyl compounds; o-naphthoquinone diazido sulfonic acid amides or o-naphthoquinonediazido carboxylic acid amides of aromatic amine compounds, for instance, esters of naphthoquinone-1,2-diazido sulfonic acid with polyhydroxyphenyl; esters of naphthoquinone-1,2-diazido-4-sulfonic acid or naphthoquinone-1,2-diazido-5-sulfonic acid with pyrogallol/acetone resins; esters of naphthoquinone-1,2-diazidosulfonic acid with novolac-type phenol/formaldehyde resins or novolac-type cresol/formaldehyde resins; amides of poly(p-aminostyrene) and naphthoquinone-1,2-diazido-4-sulfonic acid or naphthoquinone-1,2-diazido-5-sulfonic acid; esters of poly (p-hydroxystyrene) and naphthoquinone-1,2-diazido-4-sulfonic acid or naphthoquinone-1,2-diazido-5-sulfonic acid; and amides of polymeric amines with naphthoquinone-1,2-diazido-4-sulfonic acid. The term "ester" used herein also includes partial esters.

Preferred compositions contain naphthoquinone diazide moieties of the following structure:

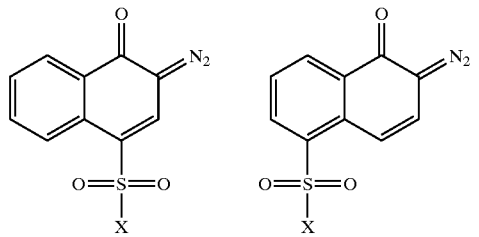

2,1,4-NQD 2,1,5-NQD where X is preferably a polymer; but could be a ballast moiety, for example a dihydroxybenzophenone group.

The composition may comprise a polymer selected from the group consisting of polyurethanes, phenolic resins, poly (hydroxystyrenes) and polyacrylic resins, as homopolymers, copolymers or terpolymers. Preferably the polymeric composition includes a polymer having hydroxyl groups. Preferably the composition contains at least 20%, more preferably at least 50%, most preferably at least 70%, of such a resin, or of such resins in total, by weight on total weight of the composition.

Particularly useful phenolic resins for compositions useful in this invention are condensation reaction products between appropriate phenols, for example phenol itself, C-alkyl substituted phenols (including cresols, xylenols, p-tert-butyl-phenol, p-phenylphenol and nonyl phenols), diphenols e.g. bisphenol-A (2,2-bis(4-hydroxyphenyl) propane), and appropriate aldehydes, for example formaldehyde, chloral, acetaldehyde and furfuraldehyde. Dependent on the preparation route for the condensation a range of phenolic materials with varying structures and properties can be formed. particularly useful in this invention are novolak resins, resole resins and novolak/resole resin mixtures. Most preferred are novolak resins. The type of catalyst and the molar ratio of the reactants used in the preparation of phenolic resins determines their molecular structure and therefore the physical properties of the resin. An aldehyde: phenol ratio between 0.5:1 and 1:1, preferably 0.5:1 to 0.8:1 and an acid catalyst is used to prepare novolak resins.

Examples of suitable novolak resins have the following general structure

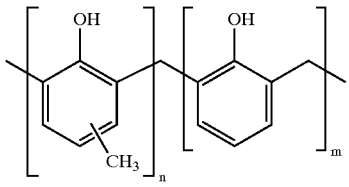

where the ratio of n:m is in the range of 1:20 to 20:1, preferably 3:1 to 1:3. In one preferred embodiment n=m. However, in certain embodiments n or m may be zero. Novolak resins suitable for use have a molecular weight in the range of about 500–20,000, preferably in the range of about 1000–15,000, say about 2500–10,000.

Other polymers suitable for inclusion in the composition, notably in admixture with a phenolic, preferably novolak, resin, include: poly-4-hydroxystyrene; copolymers of 4-hydroxystyrene, for example with 3-methyl-4-hydroxystyrene or 4-methoxystyrene; copolymers of (meth) acrylic acid, for example with styrene; copolymers of maleiimide, for example with styrene; hydroxy or carboxy functionalized celluloses; dialkylmaleiimide esters; copolymers of maleic anhydride, for example with styrene; and partially hydrolyzed polymers of maleic anhydride.

The Tg of typical compositions containing novolak resins is about 90–110° C. depending on the novolak resins selected, on their amount by weight in the composition, and on other components of the composition.

The composition may be such that it is imagewise exposable by heat, preferably image-wise insolubilized or imagewise solubilized by heat. In broad terms there are three ways in which heat can be imagewise delivered to the composition, in use. These are:

Direct heat, by which we mean the direct delivery of heat by a heated body, by conduction. For example the composition may be contacted by a heat stylus; or the reverse face of the substrate onto which the composition has been coated may be contacted by a heated body. A heated body may be a heat stylus.

The use of incident electromagnetic radiation to expose the composition, the electromagnetic radiation being converted to heat, either directly or by a chemical reaction undergone by a component of the composition. The electromagnetic radiation could for example be infra-red, or UV or visible radiation, depending on the composition. Preferably it is infra-red.

The use of charged-particle radiation, for example electron beam radiation. Clearly, at the fundamental level the charged-particle mode and the electromagnetic mode are convergent; but the distinction is clear at the practical level.

In patternwise exposing the precursor to heat the use of electromagnetic radiation is preferred.

In order to increase the sensitivity of heat sensitive compositions used in the present invention it is beneficial in embodiments intended for exposure using electromagnetic radiation to include an additional component, namely a radiation absorbing compound capable of absorbing the incident electromagnetic radiation and converting it to heat (hereinafter called a "radiation absorbing compound"). It may also be desirable to include a suitable radiation-absorbing compound in embodiments intended for exposure using charged particle radiation.

In preferred compositions intended to require electromagnetic radiation for exposure, the composition may be such that it can be exposed by means of a laser under digital control. Preferably, such a laser emits radiation at above 450 nm, preferably above 500 nm, more preferably above 600 nm, and especially above 700 nm. Most preferably it emits radiation at above 800 nm. Suitably it emits radiation of wavelength below 1400 nm, preferably below 1300 nm, more preferably below 1200 nm.

Examples of lasers which can be used to expose compositions suitable for the method of the present invention include semiconductor diode lasers emitting at between 450 nm and 1400 nm, especially between 600 nm and 1200 nm. One example is the Nd YAG laser which emits at 1064 nm and another is the diode laser used in the CREO TRENDSETTER thermal image setter, which emits at 830 nm, but any laser of sufficient imaging power and whose radiation is absorbed by the composition to produce heat, can be used.

Preferably the radiation absorbing compound is one whose absorption spectrum is such that absorption is significant at the wavelength output of the radiation source, preferably laser, which is to be used in the patternwise exposure of precursors made by the method of the present invention. Usefully it may be an organic pigment or dye. It may be a black body radiation absorber, such as carbon black or graphite. It may be a commercially available pigment such as Heliogen Green as supplied by BASF or Nigrosine Base NG1 as supplied by NH Laboratories Inc or Milori Blue (C.I. Pigment Blue 27) as supplied by Aldrich. It may be a dye or pigment of the squarylium, merocyanine, phthalocyanine, cyanine, indolizine, pyrylium or metal dithioline classes.

In preferred compositions intended to require infra-red radiation for patternwise exposure it is preferred that their developer solubility is not increased by incident UV or visible radiation, thereby making handling of the compositions straightforward. Preferably such compositions do not comprise any UV or visible light sensitive components. However UV or visible light sensitive components which are not activated by UV or visible light due to the presence of other components, such as UV or visible light absorbing dyes or a UV or visible light absorbing topmost layer, may be present in such compositions.

Pigments are generally insoluble in the compositions and so comprise particles therein. Generally they are broad band absorbers, preferably able efficiently to absorb electromagnetic radiation and convert it to heat over a range of wavelengths exceeding 200 nm in width, preferably exceeding 400 nm in width. Generally they are not decomposed by the radiation. Generally they have no or insignificant effect on the solubility of the unheated composition, in the developer. In contrast dyes are generally soluble in the compositions. Generally they are narrow band absorbers, typically able efficiently to absorb electromagnetic radiation and convert it to heat only over a range of wavelengths typically not exceeding 100 nm in width, and so have to be selected having regard to the wavelength of the radiation which is to be used for imaging.

Suitably the radiation absorbing compound, when present, constitutes at least 0.25%, preferably at least 0.5%, more preferably at least 1%, most preferably at least 2%, preferably up to 25%, more preferably up to 20%, most preferably up to 15%, of the total weight of the composition. A preferred weight range for the radiation absorbing compound may be expressed as 0.25–25% of the total weight of the composition. More specifically, in the case of dyes the range may preferably be 0.25–15% of the total weight of the composition, preferably 0.5–8%, while in the case of pigments the range may preferably be 1–25%, preferably 2–15%. For pigments, 5–15% may be especially suitable. In each case the figures given are as a percentage of the total weight of the dried composition. There may be more than one radiation-absorbing compound. References herein to the proportion of such compound(s) are to their total content.

A preferred, heat sensitive, composition preferably includes a modifying means for modifying the properties of the composition. Such a modifying means is preferably arranged to alter the developer solubility of the composition compared to when the modifying means is not present in the composition. The modifying means may be covalently bonded to a polymer of the composition or may be a compound which is not covalently bonded thereto.

The modifying means may be selected from:

Functional groups as described in WO 99/01795, which is incorporated herein by reference.

Diazide moieties described in WO 99/01796, which is incorporated herein by reference.

Separate compounds, not being diazide moieties, and described in WO 97/39894, WO 99/08879 and WO 99/21725, all of which are incorporated herein by reference. Examples described include nitrogen-containing compounds wherein at least one nitrogen atom is either quarternized or incorporated in a heterocyclic ring; or quarternized and incorporated heterocyclic ring. Examples of useful quarternized nitrogen containing compounds are triaryl methane dyes such as Crystal Violet (CI basic violet 3) and Ethyl Violet. WO 97/01796 describes lithographic printing applications and WO 99/08879 describes electronic part applications of this technology. WO 99/21725 describes improvements to this technology brought about by the use of certain developer resistance aids, notably siloxane compounds.

Latent Bronsted acids, onium salts or acid generating compounds as described in patents mentioned above, for example U.S. Pat. No. 5,491,046, U.S. Pat. No. 4,708,925 and EP 819980, all of which are incorporated herein by reference.

Preferred heat solubilizable compositions are compositions which do not contain diazide moieties.

The present invention may be applied with benefit to precursors with a wide range of compositions; but particularly to such compositions for which patternwise exposure entails the delivery of radiation to selected areas of the precursor; and especially to such compositions for which delivery of radiation causes the solubility change not by irreversible chemical decomposition. In certain compositions used in the present invention, radiation imaging produces areas which have transient increased solubility in the developer. After an interval such areas may partially or wholly revert to their original, non-imaged level of solubility. Thus the mode of action of such compositions does not require radiation-induced lysis of the reversible insoluble means but, more likely, the break-up of a physico-chemical complex, which can re-form. Consequently, in such preferred embodiments the precursor is contacted with a developer within a time period of 20 hours or less of the exposure to imaging radiation, preferably within about 120 minutes of exposure, and most preferably immediately after exposure.

Certain compositions useful in the present invention may contain a reversible insolubilizer compound and, preferably, an infra-red absorbing compound; or a compound which functions as a reversible insolubilizer compound and as an infra-red absorbing compound. Examples are given in WO 97/39894, WO 99/08879 and WO 99/21725. Indeed, the compositions and precursors described in WO 97/39894, WO 99/08879 and WO 99/21725 are preferred compositions and precursors to which the present invention can be applied.

Suitably a reversible insolubilizer compound, when present (whether or not also acting as a radiation absorbing compound) constitutes at least 1%, preferably at least 2%, preferably up to 15%, more preferably up to 25% of the total weight of the composition.

An especially preferred heat-soluble composition useful in the present invention thus comprises a composition as defined above, and, additionally, either an infra-red absorbing compound to convert infra-red radiation to heat and a said reversible insolubilizer compound as described in WO 97/39894 and WO 99/08879; or an infra-red absorbing compound which converts infra-red radiation to heat and which also functions as a reversible insolubilizer compound.

Suitably the composition useful in the present invention, regardless of whether it is patternwise solubilized by heat, visible or UV radiation, additionally contains a developer resistance means as defined in WO 99/21725, suitably a siloxane, preferably constituting 1–10 wt % of the composition. Preferred siloxanes are substituted by one or more optionally substituted alkyl or phenyl groups, and most preferably are phenylalkylsiloxanes and dialkylsiloxanes. Preferred siloxanes have between 10 and 100 —Si(R1)(R2)O— repeat units. The siloxanes may be copolymerized with ethylene oxide and/or propylene oxide. For further information on preferred siloxanes the definitions in WO 99/21725 may be recited.

The compositions used in the invention may contain other ingredients such as stabilizing additives, inert colorants, and additional inert polymeric binders as are present in many positive working compositions.

In certain embodiments of the invention an additional layer comprising a radiation-absorbing compound can be used. This multiple layer construction can provide routes to high sensitivity as larger quantities of absorber can be used without affecting the function of the image-forming layer. In principle any radiation absorbing material which absorbs sufficiently strongly in the desired band can be incorporated or fabricated in a uniform coating. Dyes, metals and pigments (including metal oxides) may be used in the form of vapor deposited layers. Techniques for the formation and use of such films are well known in the art, for example as described in EP-A-652483, incorporated herein by reference.

In the specification when it is stated that a composition is developer soluble it is intended that it is soluble in a selected developer, to an extent useful in a practical development process. When it is stated that a composition is developer insoluble it is intended that it is not soluble in the selected developer, to an extent useful in a practical development process.

Thus in preferred embodiments a positive working pattern may be obtained after patternwise exposure and development of a precursor made by the method of the present invention. The developer solubility of the composition after it has been subjected to patternwise exposure is greater than the solubility of the corresponding unexposed composition. In preferred embodiments this solubility differential is increased by means of additional components and/or by resin modification, as described herein, and in our earlier patent applications which are referred to. Preferably such measures reduce the solubility of the composition, prior to the patternwise exposure. On subsequent patternwise exposure the exposed areas of the composition are rendered more soluble in the developer, than the unexposed areas. Therefore on patternwise exposure there is a change in the solubility differential of the unexposed composition and of the exposed composition. Thus in the exposed areas the composition is dissolved, to form the pattern.

The coated precursor produced by the method of the invention may in use be patternwise exposed indirectly by exposure to a short duration of high intensity radiation transmitted or reflected from the background areas of a graphic original located in contact with the recording material.

The developer is dependent on the nature of the polymeric substance, but is preferably an aqueous developer. Common components of aqueous developers are surfactants, chelating agents such as salts of ethylenediamine tetraacetic acid, organic solvents such as benzyl alcohol, and alkaline components such as inorganic metasilicates, organic metasilicates, hydroxides or bicarbonates.

Preferably an aqueous developer is an alkaline developer containing one or more inorganic or organic metasilicates.

According to a second aspect of the present invention, there is provided an imaged member produced by the method of the first aspect of the invention.

The following examples more particularly serve to illustrate the present invention described hereinabove.

Materials and Equipment

The following materials are referred to hereinafter:

Epoxy prepeg: 60 cm long sheet of FR for Epoxy prepeg, gauge 0.23 mm, having the following characteristics:

Warp and weft tex EC9-68, weight 202 gsm, warp treads 17.3 $cm^{-1}$, weft treads 12 $cm^{-1}$, supplied by New England Laminates Incorporated UK Limited, Skelmersdale, UK;

Phenolic paper—60 long sheet of phenolic paper prepeg having a 0.270 mm gauge, supplied by Central Plastics (Industrial) Limited, Bishop's Stortford, UK;

OYO thermal imagesetter—a G5618-400 thermal plotter supplied by Oyo Instruments Inc. Texas, US;

Mathis Labdrier type LTD oven supplied by Werner Mathis AG, Zurich, Switzerland;

Steel Plates—supplied by Accura Holdings Ltd, Wolverhampton, UK;

Gas fired oven—bespoke oven supplied by Sawyer and Smith Corporation, Cleveland, Ohio, US;

Industrial press—a Beckman-RIIC press, supplied by Beckman, London, UK;

Hounsfield Tensometer HTE—supplied by Hounsfield Limited, Croydon, UK;

Sodium silicate solution: a sodium silicate solution having a $SiO_2$:$Na_2O$ ratio in the range 3.17 to 3.45, and comprising 27.1 to 28.1 wt % $SiO_2$ and 8.4 to 8.8 wt % $NaO_2$ in distilled water;

Deionized water—deionized water having a resistivity of 5 Mohm.$cm^{-1}$;

Aluminum oxide powder—$Al_2O_3$ powder comprising aluminum (9.6 wt %) in the shape of hexagonal platelets, having a mean particle size of 3 $\mu$m, and a hardness of 9 Moh (on a 0 to 10 hardness scale);

Dowfax 2A1—an anionic surfactant comprising a mixture of mono- and di-sulphonates, supplied by Dow Chemicals, Middlesex, UK;

Titanium Dioxide—rutile $TiO_2$ provided with an organic coating of $Al_2O_3$, ZnO and $ZnPO_4$, and having a mean crystal size of 0.23 $\mu$m, supplied by Tioxide, Billingham, UK;

LB6564—a phenol/cresol novolak resin supplied by Bakelite, UK;

Dye A—crystal violet (basic violet 3, C.I. 42555, Gentian Violet) supplied by Aldrich Chemical Company, Dorset, UK;

Developer A—7.5 wt % sodium metasilicate pentahydrate in water.

EXAMPLE 1

Thermal Curing Technique

Sheets of epoxy prepeg and phenolic paper, as supplied by the supplier, were tested to determinate the following properties of the sheets:

(1) The elastic yield force (2) the elastic yield (3) the percentage elongation at the elastic yield (4) the Young's modulus (5) the break force required to reach break point (6) the break point (7) the percentage elongation at break point.

Testing of the seven characteristics was performed using the Hounsfield Tensometer HTE. Each of the paper or plastics substrate sheets was cut to a standard template shape, of rectangular cross-section.

The template was attached to the tensometer and a suitable load connected to provide stress on the template. The stress, proportional to the load was increased by moving the load at a rate of 1 mm.min$^{-1}$. The seven characteristics listed above were measured electronically using the tensometer.

Fresh sheets of epoxy prepeg and phenolic paper were then passed through the OYO thermal imagesetter at 0.5 inches per second.

The epoxy prepeg and phenolic paper sheets that had been passed through the imagesetter were then treated to increase their dimensional stability by placing them in a Mathis Labdrier oven and heating the sheets at 250° C. for 2 minutes.

The sheets were then removed from the oven cut to template shape as above, and tested to determine the seven properties listed above, as for the untreated sheets.

The results of the tests for both the untreated and treated sheets are shown in Table 1 below:

TABLE 1

| Treatment | Elastic Yield Force (N) | Elastic yield (MPa) | % Elongation at Elastic Yield | Young's Modulus (GPa) | Break Force (N) | Break Yield (MPa) | Elongation at Yield |
|---|---|---|---|---|---|---|---|
| Woven Epoxy prepeg | | | | | | | |
| As supplied | 459 | 279 | 1.3 | 19 | 619 | 311 | 1.2 |
| Heated | 1201 | 315 | 0.8 | 28 | 1242 | 342 | 1 |
| Phenolic paper | | | | | | | |
| As supplied | 211 | 98 | 0.9 | 10.3 | 289 | 125 | 1.1 |
| Heated | 289 | 141 | 0.73 | 20.1 | 444 | 212 | 0.9 |

The results show that thermal curing of both the phenolic paper and epoxy prepeg substrates serves to increase their dimensional stability in respect of each of the seven tests, by a significant amount. Thus the treated sheets showed an increase in resistance to mechanical stress, such as the stress, effected by clamping the sheets onto a printing cylinder or press roller.

EXAMPLE 2

Thermal Pressing Technique (Free Weight Pressing and Industrial Pressing):

(i) Free Weight (Laboratory) Pressing

The method of Example 1 was repeated but in this experiment the sheets that had been passed through the imagesetter were placed between two steel plates coated with canola machine oil and placed on a tray with 30 lbs of weight placed on top of the top steel sheet. The sheets, plates and weights were then placed in Mathis Labdryer oven and heated to 250° C. for 2 minutes.

The sheets were tested as in Example 1 and the results are shown in Table 2 below.

The results of thermal pressing using free weight pressing of both the epoxy and paper substrates show that the dimensional stability of the substrates is increased to a greater extent than by thermal curing alone, thus showing an increased resistance to damage caused by mechanical stress such as may be effected when the substrates are clamped or otherwise connected to print rollers or cylinders.

(ii) Industrial Pressing

The method of Example 1 was repeated but the epoxy and phenolic sheets were placed in a Beckman-RIIC industrial press which applied heat with 80° C. and 150 lbs per square inch pressure to the sheets. The sheets were kept in the press for 30 seconds.

The treated sheets were removed from the oven and tested as in Example 1. The results are shown in Table 2 below.

The results of thermal pressing using an industrial press show that the dimensional stability of the epoxy and paper substrates was increased beyond that achieved by either thermal curing or thermal curing with free weight pressing.

TABLE 2

| Treatment | Elastic Yield Force (N) | Elastic yield (MPa) | % Elongation at Elastic Yield | Young's Modulus (GPa) | Break Force (N) | Break Yield (MPa) | % Elongation at Yield |
|---|---|---|---|---|---|---|---|
| Woven Epoxy prepeg | | | | | | | |
| As supplied | 544 | 297 | 1.5 | 21 | 544 | 297 | 2.2 |
| Laboratory | 894 | 342 | 1.4 | 35 | 689 | 341 | 1.6 |
| Industrial | 1350 | 475 | 1.2 | 41 | 1350 | 474 | 1.2 |
| Phenolic paper | | | | | | | |
| As supplied | 211 | 101 | 0.9 | 10.8 | 281 | 132 | 1.1 |
| Laboratory | 298 | 145 | 0.68 | 22 | 452 | 223 | 0.8 |
| Industrial | 320 | 161 | 0.6 | 26 | 4360 | 172 | 0.7 |

EXAMPLE 3

A hydrophilic coating was prepared by the following method. deionized water (48 g, 24 wt %) and sodium silicate solution (80 g, 40 wt %) were added to a beaker and the solution sheared using a Silverson high shear mixer operating at maximum speed. Titanium dioxide powder (36 g, 18 wt %) was then added in portions of 2 g every 10 seconds and the liquid sheared for a further 2 minutes. Aluminum powder (31 g, 18 wt %) was added in portions of 2 g every 10 seconds and the liquid sheared for a further 2 minutes. Finally, Dowfax 2A1 (0.18 wt % ) was added with stirring. The viscosity of the liquid was found to be about 10 centipoise when measured at 20° C., and a shear rate of 200 $s^{-1}$, using a Mettler Rheomat 180 viscometer incorporating a double gap geometry.

The hydrophilic coating was then coated on an epoxy prepeg substrate to give a wet film weight of about 8 $g.cm^{-2}$, and oven dried at 130° C. for 80 seconds to form a hydrophilic layer on the substrate. The coated substrate was then post-treated by immersion in aluminum sulphate (0.1M) for 30 seconds, followed by spray rinsing with tap water and drying under a fan.

A coating solution was then prepared by dissolving the following ingredient in 1-methoxypropan-2-ol:

| | |
|---|---|
| LB6564 | 70 parts by weight |
| LB744 | 28 parts by weight |
| Dye A | 2 parts by weight |

The solution was coated onto the hydrophilic substrate using a wire wound bar. The solution concentration was selected to provide a coating layer having a coating weight of 2.1 $gm^2$ when coated on the hydrophilic substrate and dried at 100° C. for 3 minutes in a Mathis Labdrier LTD oven.

The coated substrate was then imaged in the OYO thermal plotter under the following parameters:

1. 400×800 dpi
2. power set at 50% of the maximum internal figure
3. transport speed set at 0.5 inches per second The imaged substrate was then hand-processed by immersion in developer A at 20° C. for 15 seconds. The thermally sensitive coating dissolved away in the developer in the regions where it had received direct heat imaging in the thermal setter, to produce a printing form having image and non-image areas.

The imaged and developed printing form was then treated to increase its dimensional stability by placing it in the Mathis Labdrier oven at 250° C. for 2 minutes. The plates were then removed from the oven and left to cool for 24 hours.

The printing forms were mounted on a Micheler sheet-fed press and the image area coated with black ink containing 1.5 wt % calcium carbonate. It was found that 2000 excellent reproductions could be achieved under accelerated wear conditions.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extend to any novel one, or any novel combination, of the features disclosed in this specification (including any accompanying claims, abstract and drawings), or to any novel one, or any novel combination, of the steps of any method or process so disclosed.

The invention claimed is:

1. A method of preparing a printing plate or electronic part, the method comprising the steps of:

(a) imaging an untreated plate or part precursor having an imageable coating disposed on a substrate to produce an imaged plate or part precursor having imaged and non-imaged areas;

(b) selectively removing the imageable coating to produce an imaged plate or part; and (c) treating the imaged plate or part by exposing the imaged plate or part to heat at a temperature sufficient to initiate thermal cross-linking of free functional groups of the substrate of the imaged plate or part and produce a treated plate or part.

2. The method as claimed in claim 1, wherein the imaged plate or part is further exposed to at least one of pressure or radiation.

3. The method as claimed in claim 2, wherein the imaged plate or part is exposed simultaneously to pressure and a temperature sufficient to initiate thermal cross-linking of free functional groups of the substrate of the imaged plate or part.

4. The method as claimed in claim 2, wherein the imaged plate or part is exposed to a chemical cross-linking agent before or during exposure to at least one of heat, pressure or radiation.

5. The method as claimed in claim 1, wherein the imaged plate or part is heated to a temperature of at least 200° C.

6. The method as claimed in claim 1, wherein the imaged plate or part is exposed to heat at a temperature sufficient to initiate thermal cross-linking of free functional groups of the substrate for at least 60 seconds.

7. The method as claimed in claim 1, wherein the substrate of the imaged plate or part is plastic, rubber or paper.

8. The method as claimed in claim 1, wherein the substrate of the imaged plate or part comprises a plastic substrate having an elastic yield and wherein the force needed to exceed the elastic yield of the substrate of the treated plate or part is at least 30% larger than the force needed to exceed the elastic yield of the substrate of the untreated plate or part.

9. The method as claimed in claim 1, wherein the substrate of the imaged plate or part comprises a plastic substrate having an elastic yield, and wherein the elastic yield of the substrate of the treated plate or part is at least 3% larger than the elastic yield of the substrate of the untreated plate or part.

10. The method as claimed in claim 1, wherein the substrate of the imaged plate or part comprises a plastic substrate having a percent elongation at an elastic yield point, and wherein the percentage elongation at the elastic yield point of the substrate of the treated plate or part is at least 3% smaller than the percentage elongation at the elastic yield point of the substrate of the untreated plate or part.

11. The method as claimed in claim 1, wherein the substrate of the imaged plate or part comprises a plastic substrate having a Young's modulus, and wherein the Young's Modulus of the substrate of the treated plate or part is at least 20% larger than the Young's Modulus of the substrate of the untreated plate or part.

12. The method as claimed in claim 1, the substrate of the imaged plate or part comprises a plastic substrate having a force needed to exceed the break point of the substrate, and wherein the force needed to exceed the break point of the substrate of the treated plate or part is at least 5% larger than the force needed to exceed the break point of the substrate of the untreated plate or part.

13. The method as claimed in claim 1, wherein the substrate of the imaged plate or part comprises a plastic substrate having a break point, and wherein the break point of the substrate of the treated plate or part is at least 3% larger than the break point of the substrate of the untreated plate or part.

14. The method as claimed in claim 1, wherein the substrate of the imaged plate or part comprises a plastic substrate having a percent elongation at a break point, and wherein the percentage elongation at the break point of the substrate of the treated plate or part is at least 5% smaller than the percentage elongation at the break point of the substrate of the untreated plate or part.

15. The method as claimed in claim 1, wherein the substrate of the imaged plate or part comprises a paper substrate having a force needed to exceed an elastic yield and wherein the force needed to exceed the elastic yield of the substrate of the treated plate or part is at least 20% larger than the force needed to exceed the elastic yield of the substrate of the untreated plate or part.

16. The method as claimed in claim 1, wherein in the substrate of the imaged plate or part comprises a paper substrate having an elastic yield and wherein the elastic yield of the treated plate or part is at least 20% larger than the elastic yield of the substrate of the untreated plate or part.

17. The method as claimed in claim 1, wherein the substrate of the imaged plate or part comprises a paper substrate having a percentage elongation at an elastic yield and wherein the percentage elongation at the elastic yield of the treated plate or part is at least 25% smaller than the percentage elongation at the elastic yield of the substrate of the untreated plate or part.

18. The method as claimed in claim 1, wherein the substrate of the imaged plate or part comprises a paper substrate having a Young's Modulus and wherein the Young's Modulus of the treated plate or part is at least 25% larger than the Young's Modulus of the substrate of the untreated plate or part.

19. The method as claimed in claim 1, wherein the substrate of the imaged plate or part comprises a paper substrate having a force needed to exceed the break point of the substrate and the force needed to exceed the break point of the substrate of the treated plate or part is at least 25% larger than the force needed to exceed the break point of the substrate of the untreated plate or part.

20. The method as claimed in claim 1, wherein the substrate of the imaged plate or part comprises a paper substrate having a break point and wherein the break point of the substrate of the treated plate or part is at least 10% larger than the break point of the substrate of the untreated plate or part.

21. The method as claimed in claim 1, wherein the substrate of the imaged plate or part comprises a paper substrate having a percentage elongation at a break point and wherein the percentage elongation at the break point of the substrate of the treated printing plate or part is at least 5% smaller than the percentage elongation at the break point of the substrate of the untreated plate or part.

22. The method as claimed in claim 1, wherein the imageable coating is a positive working composition or a negative working composition.

23. The method as claimed in claim 1, wherein the imageable coating is a diazo coating, photopolymer coating, silver halide coating, electrophotographic coating, thermally sensitive coating, ablatable coating or a waterless printing coating.

24. The method as claimed in claim 1, wherein the coating is image-wise exposable by radiation.

25. The method is claimed in claim 24, wherein the radiation is visible and/or UV radiation.

26. The method as claimed in claim 25, wherein the wavelength of the radiation is between 300 nm and 450 nm.

27. The method as claimed in claim 1, wherein the imageable coating is imagewise exposable by heat.

28. The method as claimed in claim 1, wherein the imageable coating is selectively removed with a developer solution.

29. The method as claimed in claim 28, wherein the imaged plate is a lithographic printing plate.

30. The method as claimed in claim 28, wherein the imaged plate is a flexographic printing plate.

31. The method as claimed in claim 1, wherein the imaged areas of the imageable coating are removed.

32. A method of preparing a printing plate or electronic part, the method comprising the steps of:

(a) imaging a plate or part precursor having an imageable coating disposed on a substrate to produce an imaged plate or part precursor having imaged and non-imaged areas;

(b) selectively removing the imageable coating to produce an imaged plate or part; and (c) treating the imaged plate or part by exposing the imaged plate or part to at least 10 pounds per square inch of pressure to increase dimensional stability of the substrate of the imaged plate or part.

33. A method of preparing a printing plate or electronic part, the method comprising the steps of:

(a) imaging a plate or part precursor having an imageable coating disposed on a substrate to produce an imaged plate or part precursor having imaged and non-imaged areas;

(b) selectively removing the imageable coating to produce an imaged plate or part; and (c) treating the imaged plate or part by exposing the imaged plate or part to radiation to increase dimensional stability of the substrate of the imaged plate or part and produce a treated plate or part.

34. The method claimed in claim 33, where the radiation is ultraviolet radiation having a wavelength of between about 254 nm and about 400 nm.

35. The method as claimed in claim 33, wherein the substrate is contacted with a photoinitiator before or during exposure of the imaged plate or part to the radiation.

36. The method as claimed in claim 33, wherein the radiation is ultraviolet, visible, or infrared radiation.

37. A method of preparing a printing plate or electronic part, the method comprising the steps of:

(a) imaging a plate or part precursor having an imageable coating disposed on a substrate to produce an imaged plate or part precursor having imaged and non-imaged areas;

(b) selectively removing the imageable coating to produce an imaged plate or part; and (c) treating the imaged plate or part by exposing the imaged plate or part to a chemical agent to increase dimensional stability of the substrate of the imaged plate or part and produce a treated plate or part.

38. The method as claimed in claim 37, wherein the chemical agent is a cross-linking or curing agent.

39. A printing plate or electronic part produced by:

(a) imaging a an untreated plate or part precursor having an imageable coating disposed on a substrate to produce an imaged plate or part precursor having imaged and non-imaged areas;

(b) selectively removing the imageable coating to produce an imaged plate or part; and (c) treating the imaged plate or part by exposing the imaged plate or part to heat at a temperature sufficient to initiate thermal cross-linking of free functional groups of the substrate of the imaged plate or part and produce a treated plate or part.

40. A method of preparing a printing plate or electronic part, the method comprising the steps of:

(a) imaging an untreated plate or part precursor having an imageable coating disposed on a substrate to produce an imaged plate or part precursor having imaged and non-imaged areas; and (b) treating the imaged plate or part precursor by exposing the imaged plate or part precursor to heat at a temperature sufficient to initiate thermal cross-linking of free functional groups of the substrate of the imaged plate or part precursor and produce a treated plate or part precursor.

41. The method as claimed in claim 40, wherein the method further comprises the step of selectively removing the imageable coating from the treated plate or part precursor to produce a treated plate or part.

* * * * *